US012215932B2

(12) United States Patent
Jiang et al.

(10) Patent No.: US 12,215,932 B2
(45) Date of Patent: Feb. 4, 2025

(54) HEAT EXCHANGER

(71) Applicant: SANHUA (HANGZHOU) MICRO CHANNEL HEAT EXCHANGER CO., LTD., Zhejiang (CN)

(72) Inventors: Jianlong Jiang, Zhejiang (CN); Qiang Gao, Zhejiang (CN); Xiaoming Zhong, Zhejiang (CN); Haobo Jiang, Zhejiang (CN); Ningjie Huang, Zhejiang (CN)

(73) Assignee: SANHUA (HANGZHOU) MICRO CHANNEL HEAT EXCHANGER CO., LTD., Hangzhou (CN)

( * ) Notice: Subject to any disclaimer, the term of this patent is extended or adjusted under 35 U.S.C. 154(b) by 262 days.

(21) Appl. No.: 17/823,536

(22) Filed: Aug. 31, 2022

(65) Prior Publication Data

US 2022/0412660 A1 Dec. 29, 2022

Related U.S. Application Data

(63) Continuation of application No. PCT/CN2020/101966, filed on Jul. 14, 2020.

(51) Int. Cl.
*F28F 1/02* (2006.01)
*F25B 39/00* (2006.01)
(Continued)

(52) U.S. Cl.
CPC ..... *F28F 1/022* (2013.01); *F25B 39/00* (2013.01); *F28D 1/05383* (2013.01);
(Continued)

(58) Field of Classification Search
CPC ..... F28D 1/05383; F28D 7/16; F28F 1/022; F28F 1/025; F28F 9/02; F28F 9/0273; F28F 9/0278
See application file for complete search history.

(56) References Cited

U.S. PATENT DOCUMENTS

2005/0051317 A1* 3/2005 Chin ..... F28D 1/05391 165/177
2010/0089559 A1* 4/2010 Gorbounov ..... F25B 39/028 165/174
(Continued)

FOREIGN PATENT DOCUMENTS

CN 100439821 C 12/2008
CN 101858698 A * 10/2010
(Continued)

OTHER PUBLICATIONS

Machine translation of JP-2019074287-A (Year: 2024).*

*Primary Examiner* — Eric S Ruppert
*Assistant Examiner* — Hans R Weiland
(74) *Attorney, Agent, or Firm* — Bridgeway IP Law Group, PLLC; Jihun Kim

(57) ABSTRACT

A heat exchanger includes a first pipe, a second pipe, a plurality of heat exchange tubes, an inlet/outlet pipe, and a first member. The first pipe has a main channel, and the heat exchange tube is connected between the first pipe and the second pipe. The heat exchange tube includes a plurality of channels disposed to be spaced apart. The plurality of channels include a first channel with a largest flow cross-sectional area and a second channel with a smallest flow cross-sectional area. The first member is located in the main channel of the first pipe to define a first flow channel and a second flow channel. The first flow channel is connected to the inlet/outlet pipe, and the second flow channel is connected to the heat exchange tube. The first member includes through-holes.

20 Claims, 11 Drawing Sheets

(51) Int. Cl.
*F28D 1/053* (2006.01)
*F28F 9/02* (2006.01)
*F28D 7/16* (2006.01)

(52) U.S. Cl.
CPC ..... *F28F 1/025* (2013.01); *F28F 9/02* (2013.01); *F28F 9/0273* (2013.01); *F28F 9/0278* (2013.01); *F28D 7/16* (2013.01)

(56) References Cited

U.S. PATENT DOCUMENTS

| | | | | |
|---|---|---|---|---|
| 2011/0240276 | A1* | 10/2011 | Wintersteen | F28D 1/05383 165/173 |
| 2015/0122470 | A1* | 5/2015 | Xia | F28F 9/0273 165/174 |
| 2017/0276411 | A1* | 9/2017 | Taras | F28F 1/025 |
| 2020/0072515 | A1* | 3/2020 | Hammer | F28F 9/0282 |
| 2020/0088451 | A1* | 3/2020 | Saito | F28F 9/0268 |

FOREIGN PATENT DOCUMENTS

| | | | | | |
|---|---|---|---|---|---|
| CN | 102287969 | A | | 12/2011 | |
| CN | 203731744 | U | | 7/2014 | |
| CN | 105352345 | A | | 2/2016 | |
| CN | 210128650 | U | | 3/2020 | |
| CN | 210512739 | U | | 5/2020 | |
| CN | 210689278 | U | | 6/2020 | |
| JP | 2014037898 | A | * | 2/2014 | |
| JP | 2019074287 | A | * | 5/2019 | |
| WO | WO-2020161761 | A1 | * | 8/2020 | F25B 39/00 |

* cited by examiner

HEAT EXCHANGER

CROSS-REFERENCE TO RELATED APPLICATION

The present application is a continuation-in-part Application of International Application No. PCT/CN2020/101966, filed on Jul. 14, 2020, the contents of all of which are incorporated herein by reference in their entireties for all purposes.

TECHNICAL FIELD

Embodiments of this application relate to the field of heat exchange technologies, and more particularly, to a heat exchanger.

BACKGROUND

At present, multi-channel heat exchangers are widely used in various air-conditioning fields. In related technologies, a multi-channel heat exchanger uses a plurality of multi-channel heat exchange tubes for heat exchange, and a plurality of channels are distributed to be spaced apart in a width direction of the multi-channel heat exchange tube. When flowing into the heat exchanger, refrigerant is distributed among the plurality of heat exchange tubes and then distributed among channels of the heat exchange tube. Distribution of the refrigerant among the heat exchange tubes and among the channels affects heat exchange performance of the heat exchanger, and in some applications, hinders improvement of heat exchange performance of the multi-channel heat exchanger.

SUMMARY

A heat exchanger according to an embodiment of a first aspect of this application includes: a first pipe and a second pipe, where the first pipe includes a circumferential wall and a main channel surrounded by the circumferential wall, the heat exchanger further includes an inlet/outlet pipe, and the inlet/outlet pipe is connected to the first pipe; a plurality of heat exchange tubes, where the heat exchange tube is connected to the first pipe and the second pipe, the heat exchange tube includes a plurality of channels arranged to be spaced apart, the channel is connected to the first pipe and the second pipe, the plurality of channels include a first channel and a second channel; and on the cross section of the heat exchange tube, a flow cross-sectional area of the first channel is greater than a flow cross-sectional area of another channel different from the first channel in the plurality of channels, and a flow cross-sectional area of the second channel is less than a flow cross-sectional area of another channel different from the second channel in the plurality of channels; and a first member, where the first member is located in the main channel of the first pipe, the first member extends by a specific distance along a length direction of the first pipe, the main channel includes a first flow channel and a second flow channel, the first member is located between the first flow channel and the second flow channel, the first flow channel is connected to the inlet/outlet pipe, the second flow channel is connected to the heat exchange tube, the first member includes a plurality of through-holes, and the through-hole connects the first flow channel and the second flow channel. The flow cross-sectional area of the first channel on the cross section of the heat exchange tube is A1, the flow cross-sectional area of the second channel on the cross section of the heat exchange tube is A2, and the A1 and A2 satisfy the following expression: $0.15 \leq (A1-A2)*N/A3 \leq 3.8$, where A3 is a sum of flow cross-sectional areas of the plurality of through-holes of the first member, and N is a quantity of the heat exchange tubes connected to the main channel.

A heat exchanger according to an embodiment of a second aspect of this application includes: a first pipe and a second pipe, where the first pipe includes a circumferential wall and a main channel surrounded by the circumferential wall, an end in a length direction of the first pipe is a first end, the first end of the first pipe includes a first end surface, the heat exchanger further includes an inlet/outlet pipe, and the inlet/outlet pipe is connected to the first pipe; a plurality of heat exchange tubes, where the heat exchange tube is connected to the first pipe and the second pipe, the heat exchange tube includes a plurality of channels arranged to be spaced apart, the channel is connected to the first pipe and the second pipe, flow cross-sectional areas of the plurality of channels vary along a spacing direction of the plurality of channels on the cross section of the heat exchange tube, and the plurality of channels include a first channel and a second channel; and on the cross section of the heat exchange tube, a flow cross-sectional area of the first channel is greater than a flow cross-sectional area of another channel different from the first channel in the plurality of channels, and a flow cross-sectional area of the second channel is less than a flow cross-sectional area of another channel different from the second channel in the plurality of channels; and a first member, where the first member is located in the main channel of the first pipe, the first member extends by a specific distance along a length direction of the first pipe, the main channel includes a first flow channel and a second flow channel, the first member is located between the first flow channel and the second flow channel, the first flow channel is connected to the inlet/outlet pipe, the second flow channel is connected to the heat exchange tube, the first member includes a plurality of through-holes, and the through-hole connects the first flow channel and the second flow channel. A through-hole of the plurality of through-holes that has a smallest distance to the first end surface of the first pipe is a first through-hole, the smallest distance between the first through-hole and the first end surface of the first pipe in the length direction of the first pipe is d3, and $d3<(10d1+9d2)*A1/A2$, where d1 is a thickness of the heat exchange tube, d2 is a smallest distance between adjacent heat exchange tubes in the length direction of the first pipe, A1 is a flow cross-sectional area of the first channel on the cross section of the heat exchange tube, and A2 is a flow cross-sectional area of the second channel on the cross section of the heat exchange tube.

DETAILED DESCRIPTION

Embodiments of this application are described in detail below, and examples of the embodiments are shown in the accompanying drawings. The embodiments described below with reference to the accompanying drawings are examples, and are intended to explain this application, but shall not be understood as a limitation on this application. In the description of this application, it should be understood that an orientation or positional relationship indicated by the term "center", "longitudinal", "transverse", "length", "width", "thickness", "upper", "lower", "front", "back", "left", "right", "vertical", "horizontal", "top", "bottom", "internal", "external", "clockwise", "counterclockwise", "axial direction", "radial direction", "circumferential direction", or the like is based on an orientation or positional relationship shown in the accompanying drawings, and is merely for ease of describing this application and simplifying the description, but does not indicate or imply that an apparatus or an element fixture referred to must have a specific orientation or be constructed and operated in a specific orientation, and therefore cannot be understood as a limitation to this application.

Figure 19:
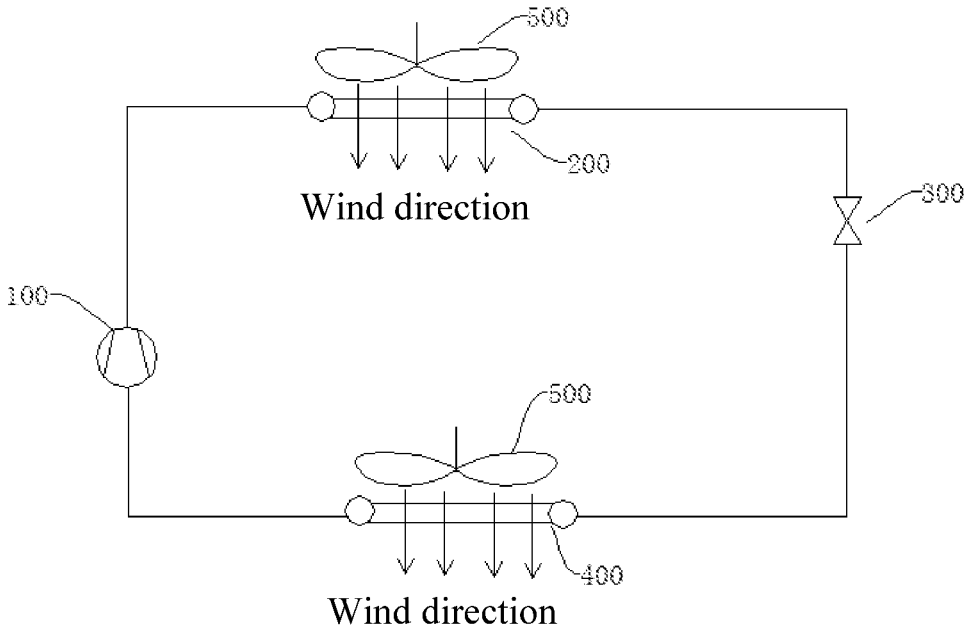
FIG. 19 is a schematic diagram of a refrigeration and air-conditioning system including a heat exchanger according to an embodiment of this application.

When a multi-channel heat exchanger works and exchanges heat in a refrigeration and air-conditioning system, refrigerant flows through an inner channel of the multi-channel heat exchanger, and airflow exchanges heat with the refrigerant in the heat exchanger through a surface of the heat exchanger. As shown in FIG. 19, the refrigeration and air-conditioning system includes a compressor 100, a first heat exchanger 200, a throttle member 300, a second heat exchanger 400, and a fan 500. The compressor 100, the first heat exchanger 200, the throttle member 300, and the second heat exchanger 400 are connected in series to form a circulation loop. A fan 500 is aligned with the first heat exchanger 200 to blow air to the first heat exchanger 200, and another fan 500 is aligned with the second heat exchanger 400 to blow air to the second heat exchanger 400. Either or each of the heat exchanger 200 and the heat exchanger 400 may be a heat exchanger 1 in this application.

The following describes a heat exchanger 1 according to an embodiment in an aspect of this application with reference to FIG. 1 to FIG. 18.

As shown in FIG. 1 to FIG. 18, the heat exchanger 1 in this embodiment of this application includes a first pipe 10, a second pipe 20, a plurality of heat exchange tubes 30, and a first member 40.

Figure 1:
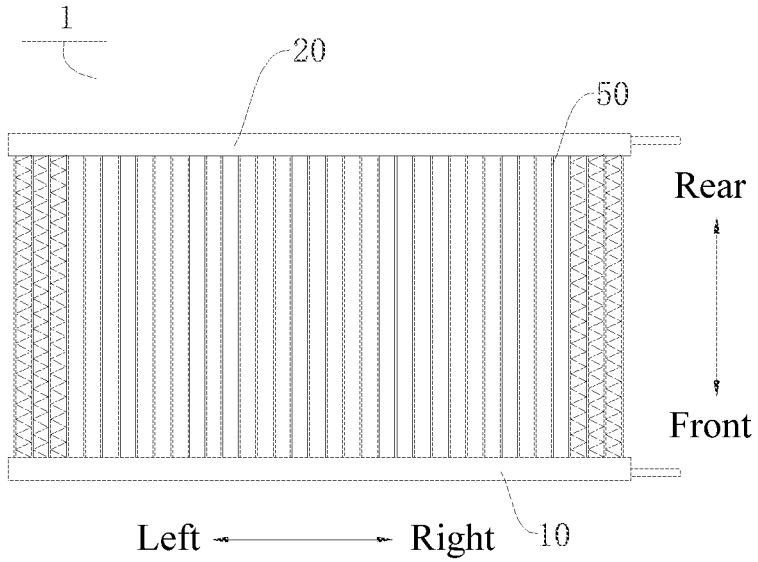
FIG. 1 is a main view of a heat exchanger according to an embodiment of this application.
Figure 2:
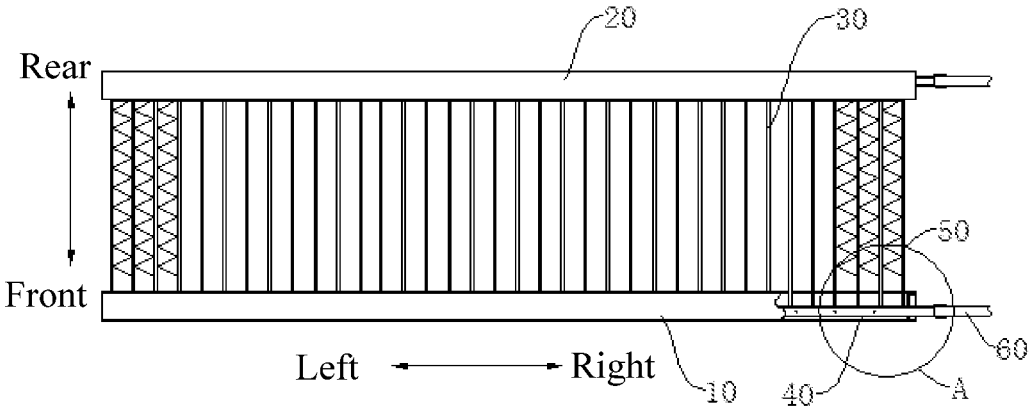
FIG. 2 is a schematic diagram of a heat exchanger according to an embodiment of this application, where a first member is shown.

The first pipe 10 includes a circumferential wall and a main channel 101 surrounded by the circumferential wall. The heat exchanger 1 further includes an inlet/outlet pipe 60, and the inlet/outlet pipe 60 is connected to the first pipe 10. As shown in FIG. 1 and FIG. 2, both the first pipe 10 and the second pipe 20 extend in a left-right direction, and the first pipe 10 and the second pipe 20 are spaced apart in a front-rear direction. The inlet/outlet pipe 60 is located on the right side of the first pipe 10, and a right end of the first pipe 10 is connected to a left end of the inlet/outlet pipe 60.

An end of the heat exchange tube 30 is connected to the first pipe 10, and the other end of the heat exchange tube 30 is connected to the second pipe 20. The heat exchange tube 30 is connected to the first pipe 10 and the second pipe 20. The heat exchange tube 30 includes a plurality of channels 301 (two or more channels 301) arranged to be spaced apart. The channel 301 is connected to the first pipe 10 and the second pipe 20. The plurality of channels 301 include a first channel and a second channel. On the cross section of the heat exchange tube 30, a flow cross-sectional area of the first channel is greater than a flow cross-sectional area of another channel 301 different from the first channel in the plurality of channels 301, and a flow cross-sectional area of the second channel is less than a flow cross-sectional area of another channel 301 different from the second channel in the plurality of channels 301.

Figure 4:
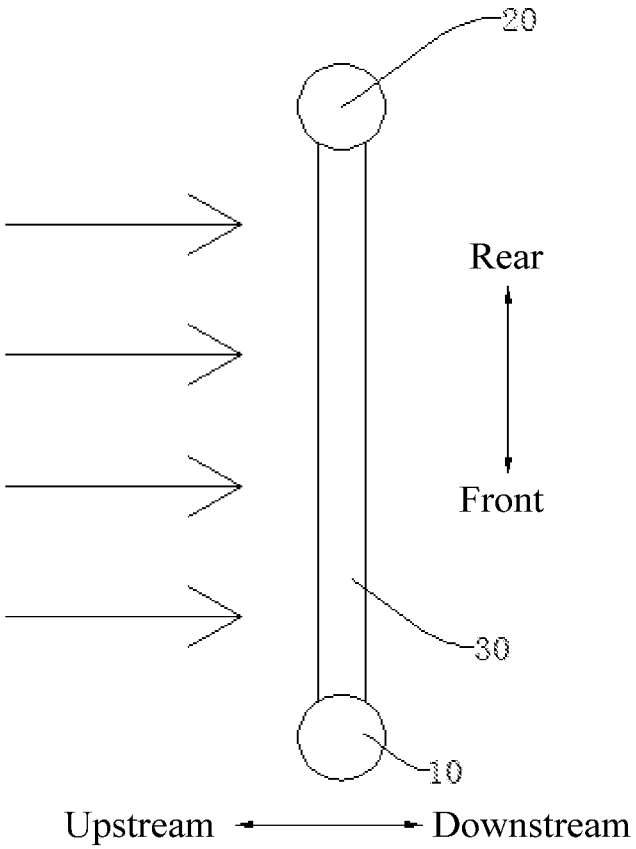
FIG. 4 is a side view of a heat exchanger according to an embodiment of this application.
Figure 5:
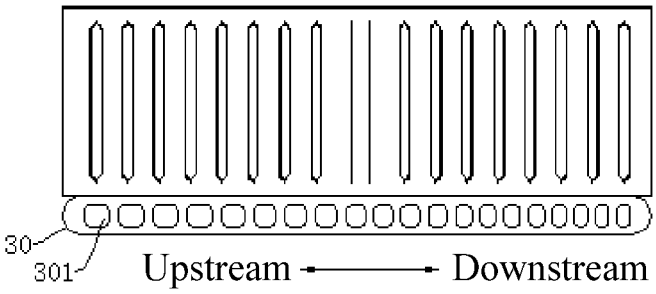
FIG. 5 is a sectional view of a heat exchange tube of a heat exchanger according to an embodiment of this application.

As shown in FIG. 1 and FIG. 2, the heat exchange tube 30 extends in the front-rear direction, and the plurality of heat exchange tubes 30 are arranged to be spaced apart between the first pipe 10 and the second pipe 20 in the left-right direction. A front end of the heat exchange tube 30 is connected to the first pipe 10, and a rear end of the heat exchange tube 30 is connected to the second pipe 20. As shown in FIG. 4 and FIG. 5, each heat exchange tube 30 is formed with a plurality of channels 301 arranged to be spaced apart in an up-down direction, and the channel 301 extends in the front-rear direction. A front end of the channel 301 is connected to the first pipe 10, and a rear end of the channel 301 is connected to the second pipe 20. A channel 301 of the plurality of channels 301 that has a largest flow cross-sectional area is a first channel, and a channel 301 of the plurality of channels 301 that has a smallest flow cross-sectional area is a second channel. It should be noted that, in this technical solution, there may be a plurality of first channels and a plurality of second channels, and flow cross-sectional areas of the plurality of channels 301 may be completely different or partially the same.

In some embodiments of the present disclosure, the plurality of channels 301 may include only two groups of channels, namely one group of first channels and the other group of second channels. That is, the plurality of channels 301 only include the first channel and the second channel. The flow cross-sectional area of the first channel is larger than the flow cross-sectional area of the second channel. It may be understood that the group of first channels may include one or more first channels, and the group of second channels may also include one or more second channels.

The first member 40 is located in the main channel 101 of the first pipe 10, and the first member 40 extends by a specific distance along a length direction of the first pipe 10. A length of the first member 40 in the main channel 101 of the first pipe 10 is less than or equal to a length of the first pipe 10. The main channel 101 includes a first flow channel 1011 and a second flow channel 1012, and the first member 40 is located between the first flow channel 1011 and the second flow channel 1012. The first flow channel 1011 is connected to the inlet/outlet pipe 60, and the second flow channel 1012 is connected to the heat exchange tube 30. The first member 40 includes a plurality of through-holes 401, and the through-hole 401 connects the first flow channel 1011 and the second flow channel 1012.

Figure 3:
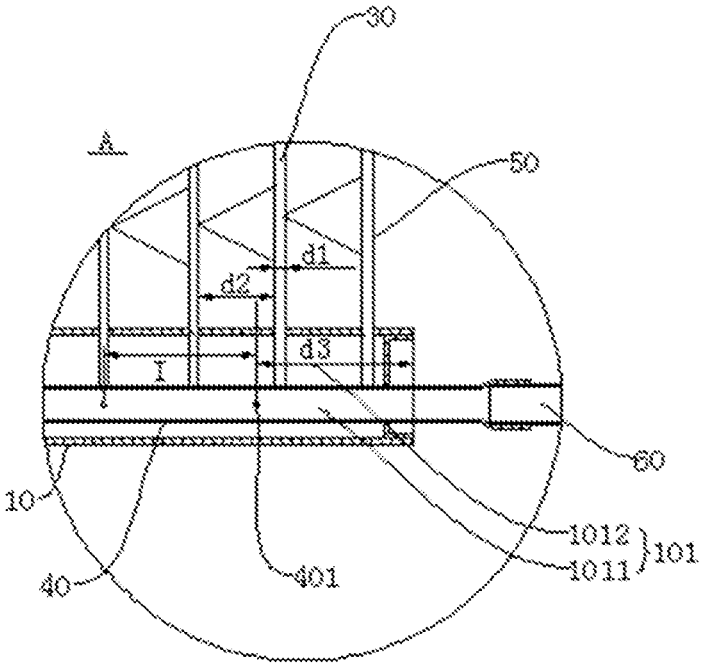
FIG. 3 is an enlarged view of part A in FIG. 2.

As shown in FIG. 2 and FIG. 3, the first member 40 penetrates through the main channel 101 in the left-right direction, and the first member 40 is provided with through-holes 401 spaced apart in the left-right direction. Both the first flow channel 1011 and the second flow channel 1012 extend in the left-right direction, and the first member 40 separates the first flow channel 1011 from the second flow channel 1012. A right end of the first flow channel 1011 is connected to the inlet/outlet pipe, and the second flow channel 1012 is connected to front ends of the plurality of heat exchange tubes 30. It may be understood that refrigerant may flow into the first flow channel 1011 along the inlet/outlet pipe, and the refrigerant in the first flow channel 1011 flows into the second flow channel 1012 through the through-holes 401 on the first member 40, and flows into the heat exchange tube 30 through connection between the second flow channel 1012 and the heat exchange tube 30 for further heat exchange.

The flow cross-sectional area of the first channel on the cross section of the heat exchange tube 30 is A1, the flow cross-sectional area of the second channel on the cross section of the heat exchange tube 30 is A2, and the A1 and A2 satisfy the following expression: $0.15 \leq (A1-A2)*N/A3 \leq 3.8$. A3 is a sum of flow cross-sectional areas of the plurality of through-holes 401 of the first member 40, and N is a quantity of the heat exchange tubes 30 connected to the main channel 101.

Figure 15:
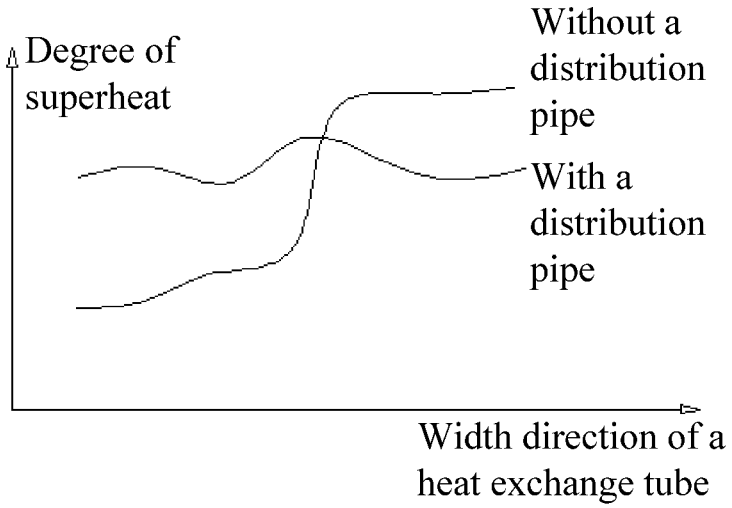
FIG. 15 is a line graph comparing degrees of superheat of a heat exchanger (with a third pipe) and a heat exchanger (without a third pipe) according to an embodiment of this application.
Figure 16:
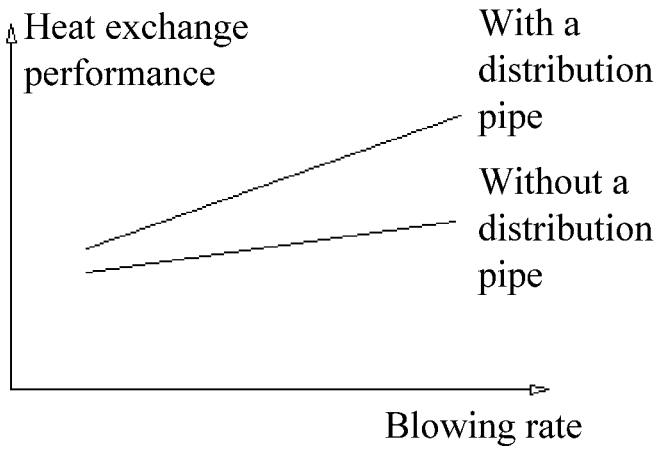
FIG. 16 is a line graph comparing heat exchange performance of a heat exchanger (with a third pipe) and heat exchange performance of a heat exchanger (without a third pipe) according to an embodiment of this application.
Figure 18:
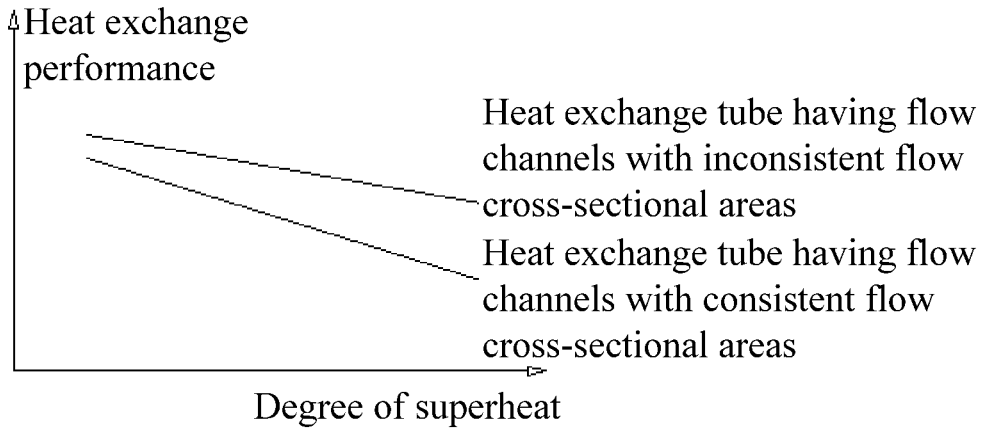
FIG. 18 is a line graph comparing heat exchange performance of a heat exchange tube (a heat exchange tube having flow channels with inconsistent flow cross-sectional areas) and heat exchange performance of a heat exchange tube (a heat exchange tube having flow channels with consistent flow cross-sectional areas) of a heat exchanger according to an embodiment of this application.

In related technologies, the first member 40 (such as a distribution pipe) is not provided in the main channel, and flow cross-sectional areas of the plurality of channels in the heat exchange tube are consistent. A heat exchanger in related technologies has problems of uneven distribution of refrigerant in the heat exchange tubes and low heat exchange efficiency. As shown in FIG. 15, FIG. 16, and FIG. 18, it is found by the applicant that when the first member is arranged in the main channel and flow cross-sectional areas of the plurality of channels in the heat exchange tube are inconsistent, it helps improve heat exchange performance of the heat exchanger, and balance a degree of superheat at an outlet of the heat exchanger.

On this basis, it is also found by the applicant that, for distribution of refrigerant in channels of the heat exchanger, a larger difference between flow cross-sectional areas of the plurality of channels in the heat exchange tube, for example, a larger flow cross-sectional area difference between the channel with the largest flow cross-sectional area and the channel with the smallest flow cross-sectional area, better helps improve heat exchange performance. In some embodiments of the present disclosure, flow cross-sectional areas of every two of at least three channels 301 in the plurality of channels 301 are not equal to each other on a cross section of the heat exchange tube 30. For example, the plurality of channels 301 may include three or more groups of channels, i.e. one group of first channels, one group of second channels, and one or more groups of other channels. Further, the flow cross-sectional area of the first channel is larger than the flow cross-sectional area of the second channel, and the flow cross-sectional area of the other channel is less than the flow cross-sectional area of the first channel and larger than the flow cross-sectional area of the second channel. It may be understood that the group of first channels may include one or more first channels, the group of second channels may also include one or more second channels, and the one or more groups of other channels each may include one or more other channels.

In addition, a total area of the through-holes on the first member is related to the distribution of the refrigerant in the heat exchange tubes. Moreover, the area of the through-holes affects a flow rate of the refrigerant flowing out of the first member. A larger flow rate better helps evenly mix gas-liquid two-phase refrigerant and better helps improve heat exchange performance. However, if the total area of the through-holes is too large, it hinders mixing of two-phase refrigerant, resulting in aggravated gas-liquid separation and reduced heat exchange performance. If the total area of the through-holes is too small, a pressure drop is large when the refrigerant flows, which also affects heat exchange performance. Therefore, the area of the through-hole on the first member needs to be designed based on a status of the heat exchanger.

When a plurality of heat exchange tubes with channels of different areas are used in cooperation with the first member, distribution of the refrigerant among the heat exchange tubes and distribution among the channels of the heat exchange tube affect each other. For example, the first member distributes refrigerant in the first pipe, and if there is no more refrigerant entering the channel with the largest flow cross-sectional area or refrigerant is evenly distributed among the channels of the heat exchange tube, it is detrimental to heat exchange performance. On the contrary, if distribution of the refrigerant in the first pipe is not even, through design of the channels of the heat exchange tube, distribution of the refrigerant in the channels of the heat exchange tube can adjust a degree of superheat of the refrigerant at the outlet of the heat exchanger and mitigate impact on heat exchange performance.

Figure 14:
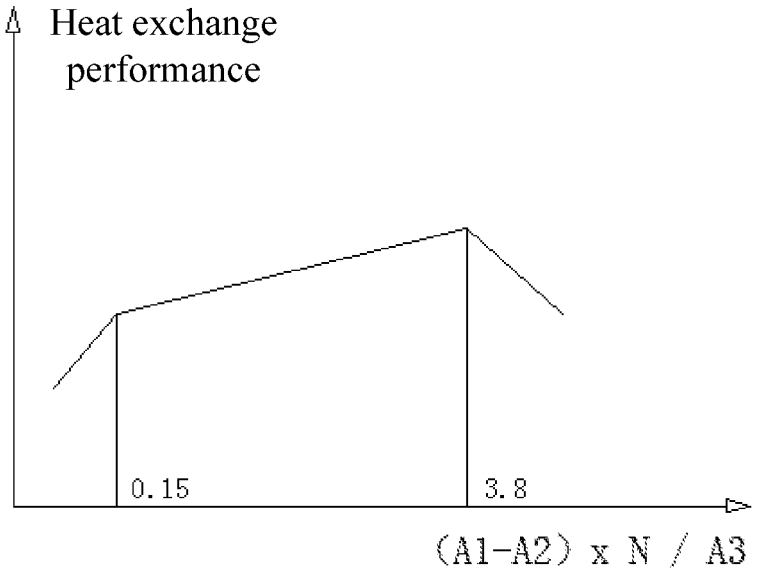
FIG. 14 is a line graph of change of heat exchange performance of a heat exchanger with a value of (A1−A2) *N/A3 according to an embodiment of this application.

Based on the analysis above, it is found by the applicant that, on the cross section of the heat exchange tube, the channel with the largest flow cross-sectional area is used as the first channel, the flow cross-sectional area of the first channel is defined as A1, the channel with the smallest flow cross-sectional area is used as the second channel, the flow cross-sectional area of the second channel is defined as A2, the quantity of heat exchange tubes connected to the main channel is N, the sum of the flow cross-sectional areas of the plurality of through-holes of the first member is A3, and there is a design relationship: $(A1-A2)*N/A3$. As shown in FIG. 14, when (A1−A2)*N/A3≤0.15 or (A1−A2)*N/A3≥3.8, heat exchange performance of the heat exchanger decreases. When 0.15≤(A1−A2)*N/A3≤3.8, the design of the heat exchanger adjusts distribution of the refrigerant among the heat exchange tubes and distribution among the channels of a same heat exchange tube, which helps improve heat exchange performance of the heat exchanger 1.

Therefore, according to the heat exchanger in this embodiment of this application, the first member is arranged in the main channel of the first pipe to define the first flow channel and the second flow channel in the main channel, and flow cross-sectional areas of the plurality of channels in the heat exchange tube are inconsistent, so that the flow cross-sectional area A1 of the first channel on the cross section of the heat exchange tube, the flow cross-sectional area A2 of the second channel on the cross section of the heat exchange tube, and the quantity N of heat exchange tubes connected to the second flow channel satisfy: 0.15≤(A1−A2)*N/A3≤3.8. This can adjust distribution of refrigerant in the heat exchanger, improve heat exchange performance of the heat exchanger, and adjust a degree of superheat at the outlet of the heat exchanger, to reduce fluctuation of opening of an expansion valve and improve running stability of the refrigeration and air-conditioning system.

In some embodiments, as shown in FIG. 2 and FIG. 3, the first member 40 is a third pipe (a distribution pipe), and the third pipe includes a third circumferential wall. The third circumferential wall is located between the first flow channel 1011 and the second flow channel 1012, and the third circumferential wall has through-holes 401 penetrating through the circumferential wall. The through-hole 401 connects the first flow channel 1011 and the second flow channel 1012, and the third pipe is connected to the inlet/outlet pipe 60 or the third pipe includes the inlet/outlet pipe.

As shown in FIG. 2, the third pipe is a round pipe and penetrates through the main channel 101 in the left-right direction. A length of a section of the third pipe is equal to a length of the first pipe 10. The circumferential wall of the third pipe has the through-holes 401 that are spaced apart in the left-right direction and that penetrate through the circumferential wall. The second flow channel 1012 is formed between the circumferential wall of the third pipe and an inner circumferential wall of the first pipe 10, the first flow channel 1011 (a third channel of the third pipe) is formed in the third pipe, and the first flow channel 1011 and the second flow channel 1012 are connected through the through-hole 401.

Specifically, refrigerant flows into the first flow channel 1011 along the inlet/outlet pipe 60, and the refrigerant in the first flow channel 1011 flows into the second flow channel 1012 through the through-holes 401 on the third pipe, and flows into the heat exchange tube 30 through connection between the second flow channel 1012 and the heat exchange tube 30. The refrigerant is in the heat exchanger 1 for heat exchange.

Figure 10:
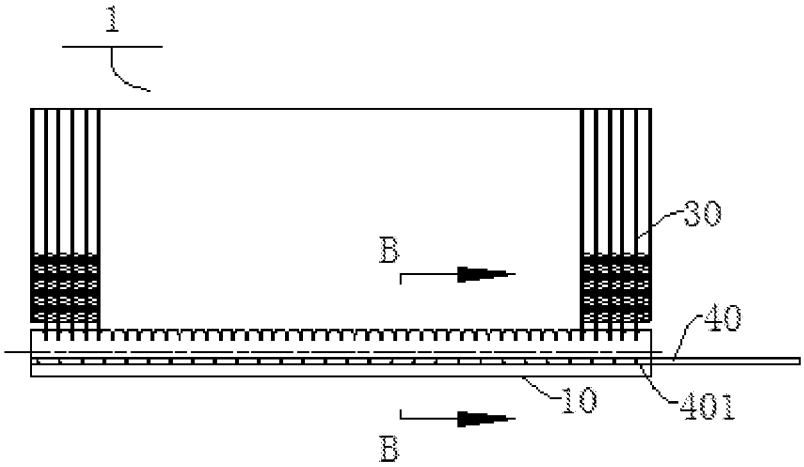
FIG. 10 is a sectional view of a heat exchanger according to an embodiment of this application.
Figure 11:
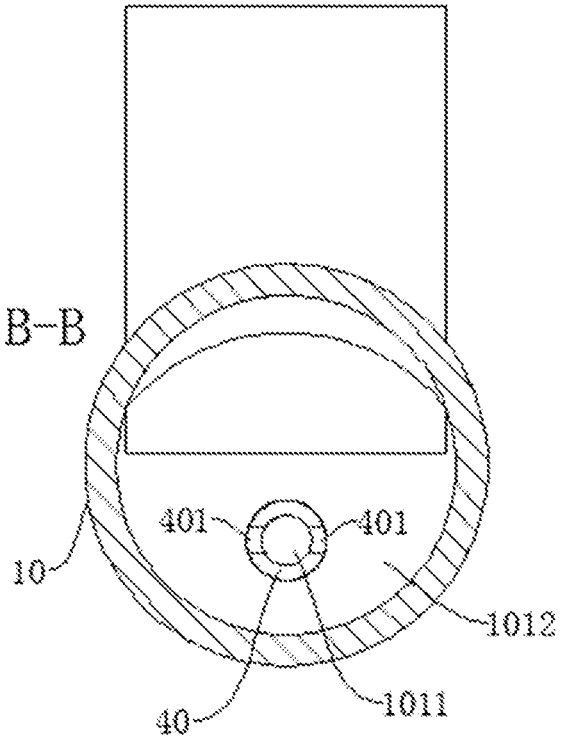
FIG. 11 is a sectional view along the B-B direction in FIG. 10.
Figure 12:
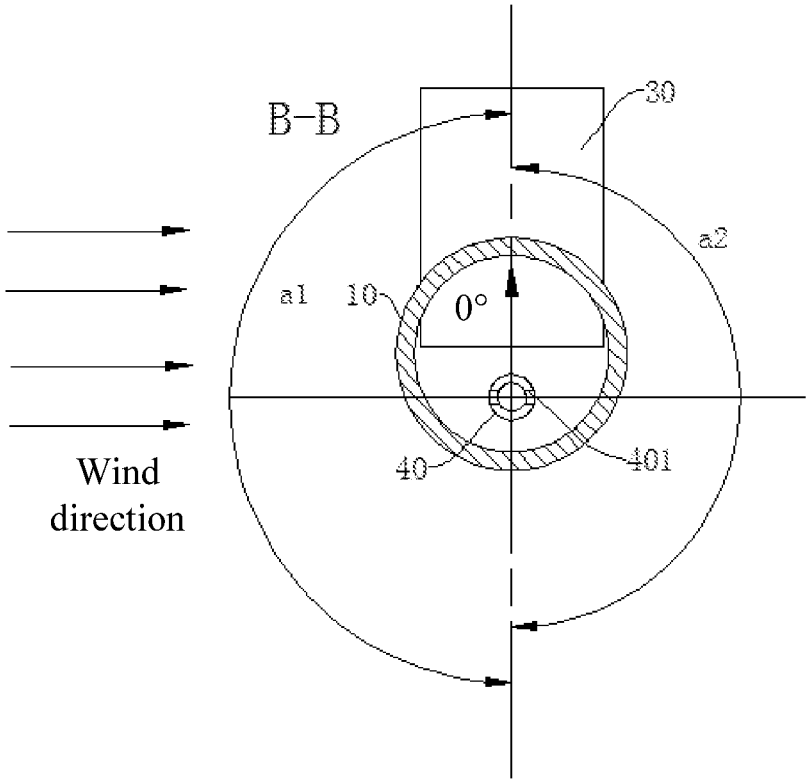
FIG. 12 is a sectional view along the B-B direction in FIG. 10, where $\alpha 1$ and $\alpha 2$ are shown.

In some embodiments, as shown in FIG. 4 and FIG. 5, a side of the heat exchanger 1 located upstream in a wind direction during heat exchange is defined as a windward side, and a downstream side of the wind direction of the heat exchanger 1 is defined as a leeward side. For example, as shown in FIG. 10 to FIG. 12, a side of through-holes 401 located upstream is the windward side, and a side of through-holes 401 located downstream is the leeward side. A direction facing an inlet of a channel of the heat exchange tube 30 is considered 0 degrees. An angle formed between a through-hole 401 located upstream and an inlet direction of the channel 301 of the heat exchange tube 30 is considered as a1. An angle formed between a through-hole 401 located downstream and the inlet direction of the channel 301 of the heat exchange tube 30 is considered as a2. An angle range of a1 is 0 to 180 degrees (including 0 degrees and 180 degrees), and an angle range of a2 is 180 to 360 degrees.

The first channel in the plurality of channels 301 is located on the windward side, and at least some of the plurality of through-holes are located on the leeward side. Therefore, flow resistance of the refrigerant passing through the first channel is relatively small, so that more refrigerant can flow to the windward side, and a temperature difference between the air flow on the windward side and the refrigerant is large, thereby improving heat exchange performance.

In some embodiments, a sum of flow cross-sectional areas of channels located on the windward side among the plurality of channels 301 is greater than a sum of flow cross-sectional areas of channels located on the leeward side among the plurality of channels 301, and at least some of the plurality of through-holes 401 are located on the leeward side.

Specifically, the wind may blow through the heat exchange tubes 30 from upstream to downstream. As shown in FIG. 4, the first channel is located upstream on the windward side, and some of the plurality of through-holes 401 are located downstream on the leeward side.

Therefore, some channels with a smaller sum of flow cross-sectional areas can be arranged on the leeward side of the heat exchange tube, other channels with a larger sum of flow cross-sectional areas can be arranged on the windward side of the heat exchange tube, and at least some of the through-holes are arranged on the leeward side of the heat exchange tube. Rebounding of an inner wall of the first pipe can be utilized, to help more refrigerant flow to the windward side, so as to adjust a degree of superheat at the outlet of the heat exchanger, and improve heat exchange performance of the heat exchanger. For example, all the through-holes 401 are located on the leeward side, and heat exchange performance of the heat exchanger is better.

In some embodiments, some through-holes of the plurality of through-holes 401 of the third pipe are located on the windward side, other through-holes of the plurality of through-holes 401 are located on the leeward side, and a sum of flow cross-sectional areas of the through-holes 401 on the windward side is less than a sum of flow cross-sectional areas of the through-holes 401 on the leeward side.

Therefore, some through-holes with a smaller sum of flow cross-sectional areas can be arranged on the leeward side of the heat exchange tube, and other through-holes with a larger sum of flow cross-sectional areas can be arranged on the windward side of the heat exchange tube. This can increase a through-hole area on the windward side and reduce a through-hole area on the leeward side, thereby allowing more refrigerant to flow to the windward side, reducing a difference between degrees of superheat of refrigerant on the windward side and the leeward side, improving refrigerant distribution of the heat exchanger, and improving heat exchange performance of the heat exchanger.

Figure 17:
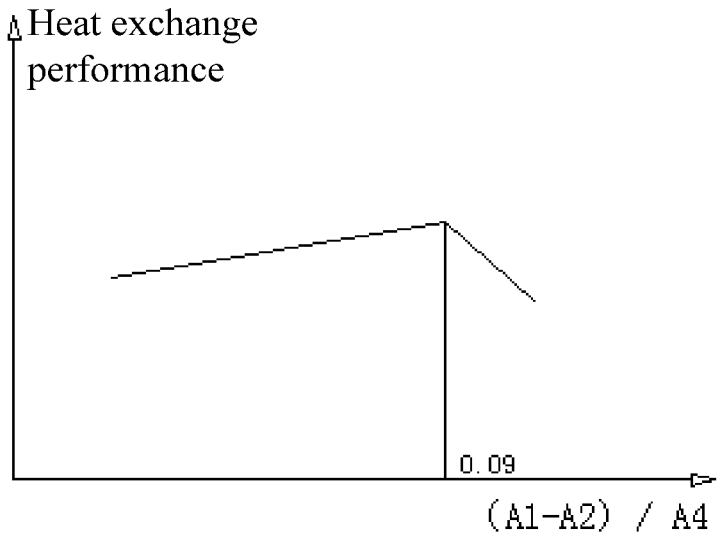
FIG. 17 is a line graph of change of heat exchange performance of a heat exchanger with a value of (A1−A2)/A4 according to an embodiment of this application.

In some embodiments, (A1−A2)/A4≤0.09, where A4 is a largest flow cross-sectional area of the third pipe. As shown in FIG. 17, when (A1−A2)/A4≤0.09, heat exchange performance of the heat exchanger 1 gradually increases with the increase of (A1−A2)/A4. For example, when (A1−A2)/A4=0.09, heat exchange performance of the heat exchanger 1 is the largest.

In some embodiments, as shown in FIG. 3, in a length direction of the third pipe, a distance I between at least two adjacent through-holes 401 satisfies: 20 mm≤I≤150 mm. Therefore, a quantity of the through-holes 401 can be properly set, to avoid that a total area of the through-holes is too large or too small, and improve reliability and uniformity of refrigerant distribution by the third pipe. For example, when 20 mm≤I≤150 mm, a distribution effect of the refrigerant is better.

Figure 8:
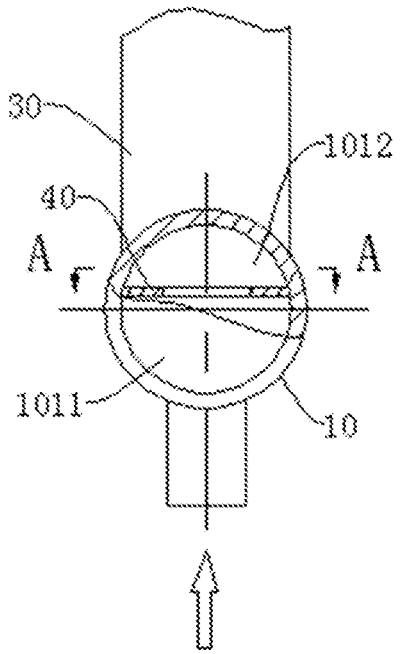
FIG. 8 is a schematic diagram of a partial structure of a heat exchanger according to an embodiment of this application.
Figure 9:
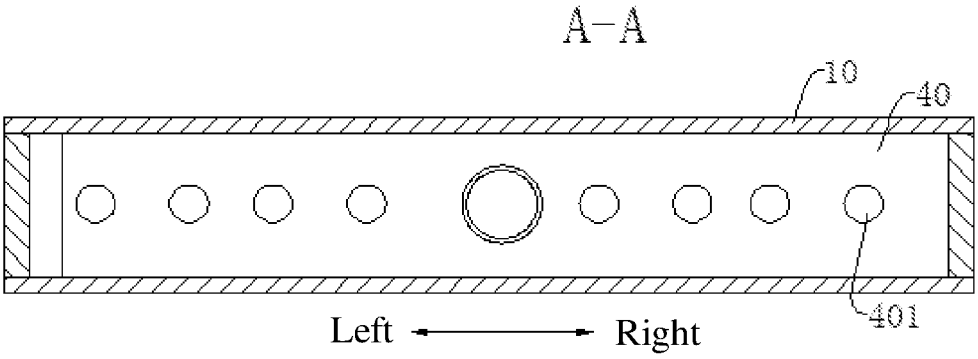
FIG. 9 is a sectional view along the A-A direction in FIG. 8.

It should be noted that the first member 40 is not limited to the third pipe shown in FIG. 2 and FIG. 3. For example, as shown in FIG. 8 and FIG. 9, the first member 40 may alternatively be a plate penetrating through the main channel 101 in the left-right direction, and the plate is provided with through-holes 401 that are arranged to be spaced apart in the left-right direction and that penetrate through the plate. The plate defines, in the main channel 101, a second flow channel 1012 located on the rear side of the plate and a first flow channel 1011 located on the front side of the plate. The refrigerant flows into the first flow channel 1011 through the inlet/outlet pipe 60. The refrigerant in the first flow channel 1011 flows into the second flow channel 1012 on the rear side of the plate through the through-holes 401 on the plate.

In some embodiments, as shown in FIG. 1 and FIG. 2, the first pipe 10 includes a first end surface, a through-hole 401 of the plurality of through-holes 401 that is adjacent to the first end surface (a right end surface of the first pipe 10 in FIG. 2) of the first pipe 10 in the length direction (the left-right direction in FIG. 2) of the first pipe 10 is a first through-hole, and a heat exchange tube 30 of the plurality of heat exchange tubes 30 that is adjacent to the first end surface of the first pipe 10 is a first heat exchange tube.

The plurality of heat exchange tubes 30 include a second heat exchange tube, a quantity of heat exchange tubes 30 located between the first heat exchange tube and the second heat exchange tube in the length direction of the first pipe 10 is greater than or equal to 10 and less than 30, and a smallest distance between the first through-hole and the first end surface 50 of the first pipe 10 in the length direction of the first pipe 10 is less than a smallest distance between the second heat exchange tube 30 and the first end surface 50 of the first pipe 10 in the length direction of the first pipe 10.

Figure 13:
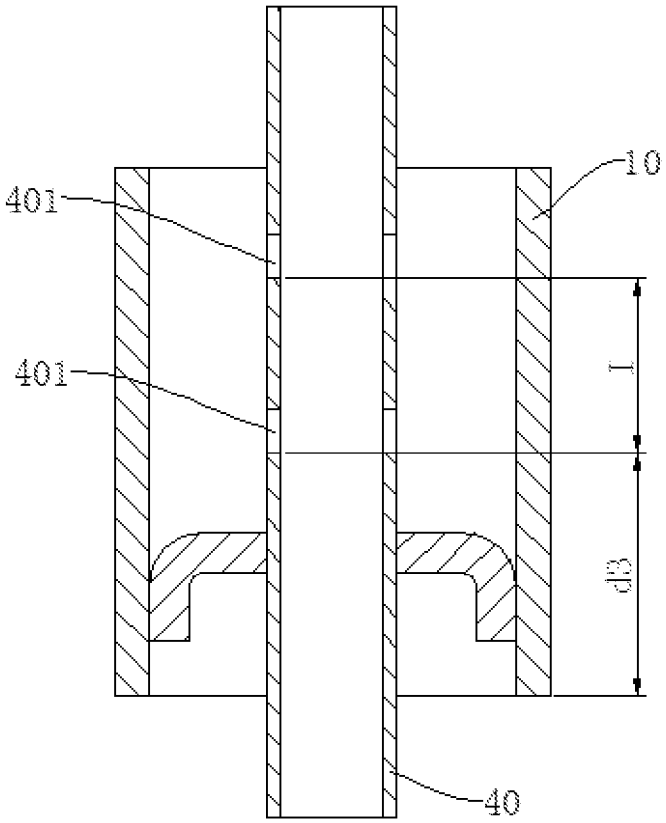
FIG. 13 is a schematic diagram of cooperation between a first pipe and a first member in a heat exchanger according to an embodiment of this application.

As shown in FIG. 2, FIG. 3, and FIG. 13, the rightmost heat exchange tube 30 of the plurality of heat exchange tubes 30 is the first heat exchange tube. The $10^{th}$ heat exchange tube 30 or the $30^{th}$ heat exchange tube 30 counted from right to left, starting from the first heat exchange tube as the $1^{st}$ heat exchange tube 30, is the second heat exchange tube. The right rightmost through-hole 401 of the plurality of through-holes 401 is the first through-hole, and a distance between a right edge of an outer circumferential wall of the first through-hole and the right end surface of the first pipe 10 in the left-right direction is less than a distance between a right side surface of the second heat exchange tube and the right end surface of the first pipe 10 in the left-right direction.

In some embodiments, as shown in FIG. 5, on the cross section of the heat exchange tube 30, the flow cross-sectional areas of the plurality of channels 301 gradually vary along a width direction of the heat exchange tube 30 (the up-down direction in FIG. 5). Therefore, differences in the flow cross-sectional areas of the plurality of channels can be utilized to increase a flow cross-sectional area of the channels on the windward side and reduce a flow cross-sectional area of the channels on the leeward side, so that more refrigerant flows to the windward side, thereby optimizing distribution of holes of the heat exchange tubes, and improving heat exchange performance.

In some embodiments, as shown in FIG. 5, on the cross section of the heat exchange tube 30, spacings between two adjacent channels 301 in the width direction (the up-down direction in FIG. 5) of the heat exchange tube 30 are equal to each other, and flow cross-sectional areas of the two adjacent channels 301 are not equal to each other. In other words, in the width direction of the heat exchange tube 30, the plurality of channels 301 are evenly spaced, that is, thicknesses of a spacing wall between the through-holes are equal, so as to further optimize distribution of the refrigerant in the heat exchange tube 30.

In some embodiments, as shown in FIG. 8, an outer circumferential contour of the cross-section of the heat exchange tube 30 is roughly quadrilateral, and an inner diameter of the second pipe 20 is 1.1 times or more of a width of the heat exchange tube 30. Therefore, when refrigerant in the channels flows into the second pipe, pressure of the refrigerant can be reduced, so as to adjust distribution of the refrigerant in the channels. In addition, pressure on a suction side of the air-conditioning and refrigeration system can be reduced, and performance of the air-conditioning and refrigeration system can be improved.

In some embodiments, as shown in FIG. 3, the heat exchange tube 30 includes a first side surface and a second side surface arranged in parallel in a thickness direction (the left-right direction in FIG. 3) of the heat exchange tube 30. A smallest distance between the channel 301 and the first side surface of the heat exchange tube 30 in the thickness direction of the heat exchange tube 30 is a first distance, and first distances of the plurality of channels 301 are equal to each other. A smallest distance between the channel 301 and the second side surface of the heat exchange tube 30 in the thickness direction of the heat exchange tube 30 is a second distance, and second distances of the plurality of channels 301 are equal to each other.

In other words, edges of the plurality of channels 301 are aligned in the thickness direction of the heat exchange tube 30, so that channels 301 with different flow cross-sectional areas can be formed only by setting dimensions of the plurality of channels 301 in the width direction of the heat exchange tube 30 to be different, which facilitates non-uniform design of the plurality of channels 301. For example, the first distance of the channel 301 is equal to the second distance of the channel 301.

The following describes a heat exchanger 1 according to another embodiment in an aspect of this application with reference to FIG. 1 to FIG. 18.

The heat exchanger 1 according to this embodiment of the present invention includes a first pipe 10, a second pipe 20, a plurality of heat exchange tubes 30, and a first member 40. The first pipe 10 includes a circumferential wall and a main channel 101 surrounded by the circumferential wall. An end in a length direction of the first pipe 10 is a first end (a right end of the first pipe 10 in FIG. 2), and the first end of the first pipe 10 includes a first end surface 50. The heat exchanger 1 further includes an inlet/outlet pipe 60, and the inlet/outlet pipe 60 is connected to the first pipe 10.

As shown in FIG. 1 and FIG. 2, both the first pipe 10 and the second pipe 20 extend in a left-right direction, and the first pipe 10 and the second pipe 20 are spaced apart in a front-rear direction. The right end of the first pipe 10 includes a first end surface. The inlet/outlet pipe is located on the right side of the first pipe 10, and the right end of the first pipe 10 is connected to a left end of the inlet/outlet pipe 60.

An end of the heat exchange tube 30 is connected to the first pipe 10, and the other end of the heat exchange tube 30 is connected to the second pipe 20. The heat exchange tube 30 is connected to the first pipe 10 and the second pipe 20. The heat exchange tube 30 includes a plurality of channels 301 arranged to be spaced apart. The channel 301 is connected to the first pipe 10 and the second pipe 20. The plurality of channels 301 include a first channel and a second channel. On the cross section of the heat exchange tube 30, a flow cross-sectional area of the first channel is greater than a flow cross-sectional area of another channel different from the first channel in the plurality of channels, and a flow cross-sectional area of the second channel is less than a flow cross-sectional area of another channel different from the second channel in the plurality of channels.

As shown in FIG. 1 and FIG. 2, the heat exchange tube 30 extends in the front-rear direction, and the plurality of heat exchange tubes 30 are arranged to be spaced apart between the first pipe 10 and the second pipe 20 in the left-right direction. A front end of the heat exchange tube 30 is connected to the first pipe 10, and a rear end of the heat exchange tube 30 is connected to the second pipe 20. As shown in FIG. 4 and FIG. 5, each heat exchange tube 30 is formed with a plurality of channels 301 arranged to be spaced apart in an up-down direction, and the channel 301 extends in the front-rear direction. A front end of the channel 301 is connected to the first pipe 10, and a rear end of the channel 301 is connected to the second pipe 20. A channel 301 of the plurality of channels 301 that has a largest flow cross-sectional area is a first channel, and a channel 301 of the plurality of channels 301 that has a smallest flow cross-sectional area is a second channel.

Figure 6:
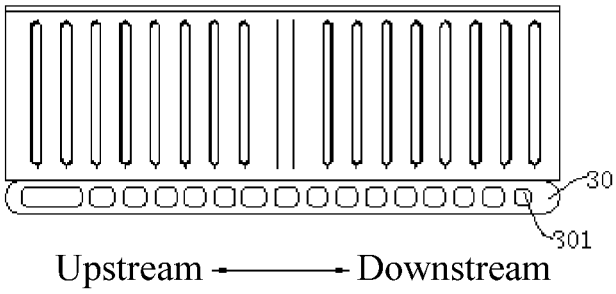
FIG. 6 is a sectional view of a heat exchange tube of a heat exchanger according to another embodiment of this application.
Figure 7:
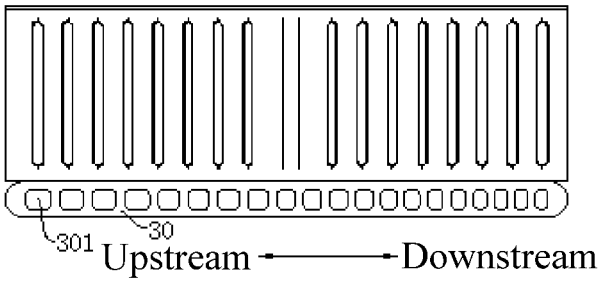
FIG. 7 is a sectional view of a heat exchange tube of a heat exchanger according to still another embodiment of this application.

It should be noted that, as shown in FIG. 6 and FIG. 7, flow cross-sectional areas of the plurality of channels 301 are different, and the plurality of channels 301 may include a large channel and a small channel (as shown in FIG. 6), or may include a group of large channels and a group of small channels (as shown in FIG. 7), or flow cross-sectional areas of the plurality of channels 301 vary gradually along a width direction of the heat exchange tube 30 (as shown in FIG. 5), or flow cross-sectional areas of the channels 301 vary in proportion to the width direction of the heat exchange tube 30. Certainly, flow cross-sectional areas of the channels 301 may alternatively vary according to a specific rule, such as a polynomial rule or an exponential rule along the width direction of the heat exchange tube 30.

In some embodiments of the present disclosure, the plurality of channels 301 may include only two groups of channels, namely one group of first channels and the other group of second channels. That is, the plurality of channels 301 only include the first channel and the second channel. The flow cross-sectional area of the first channel is larger than the flow cross-sectional area of the second channel. It may be understood that the group of first channels may include one or more first channels, and the group of second channels may also include one or more second channels.

In some embodiments of the present disclosure, flow cross-sectional areas of at least three channels 301 are not equal to each other on a cross section of the heat exchange tube 30. For example, the plurality of channels 301 may include three or more groups of channels, i.e. one group of first channels, one group of second channels, and one or more groups of other channels. Further, the flow cross-sectional area of the first channel is larger than the flow cross-sectional area of the second channel, and the flow cross-sectional area of the other channel is less than the flow cross-sectional area of the first channel and larger than the flow cross-sectional area of the second channel. It may be understood that the group of first channels may include one or more first channels, the group of second channels may also include one or more second channels, and the one or more groups of other channels each may include one or more other channels.

The first member 40 is located in the main channel 101 of the first pipe 10, and the first member 40 extends by a specific distance along a length direction of the first pipe 10. The main channel 101 includes a first flow channel 1011 and a second flow channel 1012, and the first member 40 is located between the first flow channel 1011 and the second flow channel 1012. The first flow channel 1011 is connected to the inlet/outlet pipe 60, and the second flow channel 1012 is connected to the heat exchange tube 30. The first member 40 includes a plurality of through-holes 401, and the through-hole 401 connects the first flow channel 1011 and the second flow channel 1012.

As shown in FIG. 2 and FIG. 3, the first member 40 penetrates through the main channel 101 in the left-right direction, and the first member 40 is provided with through-holes 401 spaced apart in the left-right direction. Both the first flow channel 1011 and the second flow channel 1012 extend in the left-right direction, and the first member 40 separates the first flow channel 1011 from the second flow channel 1012. A right end of the first flow channel 1011 is connected to the inlet/outlet pipe 60, and the second flow channel 1012 is connected to front ends of the plurality of heat exchange tubes 30. It may be understood that refrigerant may flow into the first flow channel 1011 along the inlet/outlet pipe 60, and the refrigerant in the first flow channel 1011 flows into the second flow channel 1012 through the through-holes 401 on the first member 40, and flows into the heat exchange tube 30 through connection between the second flow channel 1012 and the heat exchange tube 30 for further heat exchange.

A through-hole 401 of the plurality of through-holes 401 that is adjacent to the first end surface 50 of the first pipe 10 is a first through-hole. That is, a through-hole 401 of the plurality of through-holes 401 that has a smallest distance to the first end surface 50 of the first pipe 10 is the first through-hole. The smallest distance between the first through-hole and the first end surface 50 of the first pipe 10 in the length direction of the first pipe 10 is d3, and $d3<(10d1+9d2)*A1/A2$, where d1 is a thickness of the heat exchange tube 30, d2 is a smallest distance between adjacent heat exchange tubes 30 in the length direction of the first pipe 10, A1 is a flow cross-sectional area of the first channel on the cross section of the heat exchange tube 30, and A2 is a flow cross-sectional area of the second channel on the cross section of the heat exchange tube 30.

As shown in FIG. 2, FIG. 3, and FIG. 13, the rightmost through-hole 401 of the plurality of through-holes 401 is the first through-hole, and a distance between a right edge of an outer circumferential wall of the first through-hole and the right end surface of the first pipe 10 in the left-right direction is less than a distance between a right side surface of the second heat exchange tube and the right end surface of the first pipe 10 in the left-right direction, and is the smallest distance d3 between the first through-hole and the right end surface (the first end surface) of the first pipe 10 in the left-right direction.

It is found that the distance d3 from the first through-hole of the first member to the end of the first pipe affects distribution of refrigerant among tubes. The end of the first pipe is adjacent to the inlet/outlet pipe. When the distance exceeds a specified value, the refrigerant accumulates at the end, which affects a degree of superheat of a heat exchange tube near the inlet/outlet pipe, thereby resulting in a severe imbalance in distribution of refrigerant among the heat exchange tubes and a decrease in heat exchange performance.

On this basis, it is found that, the heat exchanger has high heat exchange performance when the thickness d1 of the heat exchange tube, the smallest distance d2 between adjacent heat exchange tubes in the length direction of the first pipe, the flow cross-sectional area A1 of the first channel on the cross section of the heat exchange tube, and the flow cross-sectional area A2 of the second channel on the cross-section of the heat exchange tube satisfy the expression: (10d1+9d2)*A1/A2 and d3<(10d1+9d2)*A1/A2.

Therefore, according to the heat exchanger in this embodiment of the present invention, the first member having a plurality of through-holes is arranged in the main channel of the first pipe to define the first flow channel and the second flow channel in the main channel, and flow cross-sectional areas of the plurality of channels in the heat exchange tube are inconsistent, so that the flow cross-sectional area A1 of the first channel on the cross section of the heat exchange tube, the flow cross-sectional area A2 of the second channel on the cross section of the heat exchange tube, the thickness d1 of the heat exchange tube, the smallest distance d2 between adjacent heat exchange tubes in the length direction of the first pipe, and the distance d3 between the first through-hole of the first member and the end of the first pipe satisfy: d3(10d1+9d2)*A1/A2. This can make degrees of superheat of the heat exchange tubes even, so that distribution of refrigerant among the heat exchange tubes is appropriate, and improves performance of the heat exchanger.

In some embodiments, an end of a third pipe is connected to the inlet/outlet pipe 60, the other end of the third pipe has a hole, and a flow cross-sectional area of the hole is less than a flow cross-sectional area of the third pipe. In this way, internal flow of the first pipe is promoted, distribution of refrigerant among the tubes is more even, and heat exchange performance is improved.

In some embodiments, a hydraulic diameter of the second pipe 20 is greater than or equal to 1.1 times of a hydraulic diameter of the first pipe 10. Therefore, a pressure drop in the heat exchange tubes and the first pipe can be balanced, distribution of refrigerant among the heat exchange tubes can be more even, and a pressure drop on a suction side of a refrigeration system can be reduced, to improve performance of the refrigeration system.

In some embodiments, an outer circumferential contour of the cross-section of the heat exchange tube 30 is roughly quadrilateral, and an inner diameter of the second pipe 20 is 1.1 times or more of a width of the heat exchange tube 30. Therefore, a pressure drop in the heat exchange tubes and the first pipe can be balanced, distribution of refrigerant among the heat exchange tubes can be more even, and a pressure drop on a suction side of a refrigeration system can be reduced, to improve performance of the refrigeration system.

The following describes a heat exchanger 1 according to some examples of this application with reference to FIG. 1 to FIG. 13.

In some examples, as shown in FIG. 1 to FIG. 13, a heat exchanger 1 includes a first pipe 10, a second pipe 20, a third pipe, an inlet/outlet pipe 60, and a plurality of heat exchange tubes 30.

Both the first pipe 10 and the first pipe 10 extend in a left-right direction, and the first pipe 10 and the second pipe 20 are spaced apart in a front-rear direction. The plurality of heat exchange tubes 30 connect the first pipe 10 and the second pipe 20, and the plurality of heat exchange tubes 30 are arranged to be spaced apart in the left-right direction. Front ends of the plurality of heat exchange tubes 30 are connected to the first pipe 10, and rear ends of the plurality of heat exchange tubes 30 are connected to the second pipe 20.

The first pipe 10 includes a first end surface 50 and a main channel extending in the left-right direction. The third pipe penetrates through the main channel in the left-right direction. A first flow channel 1011 is formed inside the third pipe, and a second flow channel 1012 is formed between a circumferential wall of the third pipe and an inner circumferential wall of the first pipe 10. The front end of the heat exchange tube 30 is connected to the second flow channel 1012. The circumferential wall of the third pipe is provided with a plurality of through-holes 401 that are arranged to be spaced apart in a length direction of the third pipe and that pass through the circumferential wall of the third pipe.

A right end of the third pipe is provided with an opening, and the opening of the third pipe is connected to an inlet of the first pipe 10. Refrigerant may flow into the first flow channel through the inlet of the first pipe 10, and the refrigerant in the first flow channel 1012 flows into the second flow channel 1012 through the through-holes 401. The refrigerant in the second flow channel 1012 may flow into the heat exchange tube 30 for heat exchange.

The heat exchange tube 30 has a plurality of channels 301 arranged to be spaced apart in an up-down direction, and the plurality of channels 301 extend in the front-rear direction. Flow cross-sectional areas of the plurality of channels 301 gradually vary along the up-down direction. Through-holes 401 with a larger sum of flow cross-sectional areas are arranged on a lower side (a windward side) of the heat exchange tube 30, and through-holes 401 with a smaller sum of flow cross-sectional areas are arranged on an upper side (a leeward side) of the heat exchange tube 30. Edges of the plurality of channels 301 are aligned in a thickness direction of the heat exchange tube 30, and smallest distances between adjacent channels 301 in the plurality of channels 301 in the up-down direction are equal to each other.

In the left-right direction, the rightmost heat exchange tube 30 of 10 heat exchange tubes 30 closest to the first end surface 50 is a first heat exchange tube 30, and the plurality of heat exchange tubes 30 include a second heat exchange tube. In a length direction of the first pipe 10, a quantity of heat exchange tubes 30 located between the first heat exchange tube and the second heat exchange tube is greater than or equal to 10 and less than 30. The rightmost through-hole 401 of the plurality of through-holes 401 is a first through-hole, and the first through-hole is located between the first heat exchange tube 30 and the second heat exchange tube 30.

In some other examples, as shown in FIG. 8 and FIG. 9, a first member 40 is a plate penetrating through the main channel 101 in the left-right direction, and the plate is provided with through-holes 401 that are arranged to be spaced apart in the left-right direction and that penetrate through the plate. The plate defines, in the main channel 101, a second flow channel 1012 located on the rear side of the plate and a first flow channel 1011 located on the front side of the plate. The refrigerant flows into the first flow channel 1011 through the inlet/outlet pipe 60. The refrigerant in the first flow channel 1011 flows into the second flow channel 1012 on the rear side of the plate through the through-holes 401 on the plate.

In the description of this specification, descriptions with reference to the term such as "an embodiment", "some embodiments", "example", "specific example", or "some examples" mean that specific features, structures, materials, or characteristics described with reference to the embodiment or example are included in at least one embodiment or example of this application. In this specification, illustrative descriptions of the foregoing terms do not necessarily refer to a same embodiment or example. Moreover, the described specific features, structures, materials, or characteristics can be combined in any one or more embodiments or examples in an appropriate manner. In addition, those skilled in the art can combine different embodiments or examples described in the specification and features of the different embodiments or examples without contradicting each other.

The terms "first", "second", and the like in the description of this application are merely used for the purpose of description, and cannot be understood as indicating or implying relative importance. In the description of this application, "a plurality of" means at least two, such as two or three, unless otherwise specifically defined.

In this application, unless otherwise expressly specified and defined, terms such as "install", "connect", "connected to", and "fasten" should be understood in a broad sense. For example, unless otherwise expressly defined, a "connection" may be a fixed connection, may be a detachable connection, or may be an integrated connection; or may be a mechanical connection, or an electrical connection or, mutually communicative connection; or may be a direct connection, or an indirect connection through an intermediate medium; or may be an inner connection between two elements, or interaction between two elements. A person of ordinary skill in the art may understand specific meanings of the foregoing terms in this application with reference to specific circumstances.

In this application, unless otherwise expressly specified and defined, that a first feature is "above" or "below" a second feature means that the first feature and the second feature are in direct contact, or are in indirect contact through an intermediate medium. Moreover, that the first feature is "over", "above", or "on" the second feature may mean that the first feature is over or obliquely above the second feature, or merely mean that the first feature is higher than the second feature in terms of heights. That the first feature is "under", "below", "under", or "beneath" the second feature may mean that the first feature is under or obliquely below the second feature, or merely mean that the first feature is lower than the second feature in terms of heights.

Although the embodiments of this application are shown and described above, it can be understood that the foregoing embodiments are examples and shall not be construed as a limitation on this application. A person of ordinary skill in the art may make changes, modifications, substitutions, and variants based on the foregoing embodiments within the scope of this application.

What is claimed is:

1. A heat exchanger, comprising:

a first pipe and a second pipe, the first pipe comprising a circumferential wall and a main channel surrounded by the circumferential wall;

an inlet/outlet pipe connected to the first pipe;

a plurality of heat exchange tubes, wherein each of the plurality of heat exchange tubes is connected to the first pipe and the second pipe, each of the plurality of heat exchange tubes comprises a plurality of channels arranged to be spaced apart, each of the plurality of channels is connected to the first pipe and the second pipe, and the plurality of channels comprise a first channel and a second channel, wherein, on a cross section of the plurality of heat exchange tubes taken along a left-right direction, a flow cross-sectional area of the first channel is greater than a flow cross-sectional area of another channel different from the first channel in the plurality of channels, and a flow cross-sectional area of the second channel is less than a flow cross-sectional area of another channel different from the second channel in the plurality of channels; and a first member, wherein the first member is disposed in the main channel of the first pipe, the first member extends by a predetermined distance along a length direction of the first pipe, the main channel comprises a first flow channel and a second flow channel, the first member is disposed between the first flow channel and the second flow channel, the first flow channel is connected to the inlet/outlet pipe, the second flow channel is connected to each of the plurality of heat exchange tubes, the first member comprises a plurality of through-holes, and each of the plurality of through-holes connects the first flow channel and the second flow channel, wherein A1 denotes the flow cross-sectional area of the first channel on the cross section of the plurality of heat exchange tubes taken along the left-right direction, A2 denotes the flow cross-sectional area of the second channel on the cross section of the plurality of heat exchange tubes taken along the left-right direction, and the A1 and A2 satisfy a following expression: $0.15 \leq (A1-A2)*N/A3 < 3.8$, wherein A3 denotes a sum of flow cross-sectional areas of the plurality of through-holes of the first member taken along the left-right direction, and N denotes a quantity of all of the plurality of heat exchange tubes connected to the main channel.

2. The heat exchanger according to claim 1, wherein the first member is a third pipe, the third pipe comprises a third circumferential wall, the third circumferential wall is disposed between the first flow channel and the second flow channel, the third circumferential wall has the plurality of through-holes penetrating through the third circumferential wall, the plurality of through-holes connects the first flow channel and the second flow channel, and the third pipe is connected to the inlet/outlet pipe or the third pipe comprises the inlet/outlet pipe.

3. The heat exchanger according to claim 2, wherein a side of the heat exchanger positioned upstream in a wind direction during heat exchange is defined as a windward side, a downstream side of the wind direction of the heat exchanger is defined as a leeward side, and the first channel is disposed on the windward side.

4. The heat exchanger according to claim 2, wherein a side of the heat exchanger positioned upstream in a wind direction during heat exchange is defined as a windward side, a downstream side of the wind direction of the heat exchanger is defined as a leeward side, and a sum of flow cross-sectional areas of channels positioned on the windward side among the plurality of channels of each of the plurality of heat exchange tubes is greater than a sum of flow cross-sectional areas of channels positioned on the leeward side among the plurality of channels.

5. The heat exchanger according to claim 3, wherein some through-holes of the plurality of through-holes in the third pipe are defined on the windward side, other through-holes of the plurality of through-holes in the third pipe are defined on the leeward side, and a sum of flow cross-sectional areas of the some through-holes on the windward side is less than a sum of flow cross-sectional areas of the other through-holes on the leeward side.

6. The heat exchanger according to claim 2, wherein $(A1-A2)/A4 \leq 0.09$, and A4 denotes a largest flow cross-sectional area of the third pipe taken along a front-rear direction.

7. The heat exchanger according to claim 2, wherein a distance I between at least two adjacent through-holes of the plurality of through-holes in a length direction of the third pipe satisfies: $20\ mm \leq I \leq 150\ mm$.

8. The heat exchanger according to claim 2, wherein the first pipe comprises a first end surface, a through-hole of the plurality of through-holes that is adjacent to the first end surface of the first pipe in the length direction of the first pipe is a first through-hole, a heat exchange tube of the plurality of heat exchange tubes that is adjacent to the first end surface of the first pipe is a first heat exchange tube, the plurality of heat exchange tubes comprise a second heat exchange tube, a quantity of heat exchange tubes located between the first heat exchange tube and the second heat exchange tube in the length direction of the first pipe is greater than or equal to 10 and less than 30, and a smallest distance between the first through-hole and the first end surface in the length direction of the first pipe is less than a smallest distance between the second heat exchange tube and the first end surface in the length direction of the first pipe.

9. The heat exchanger according to claim 1, wherein, on the cross section of the plurality of heat exchange tubes taken along the left-right direction, spacings between two adjacent channels of the plurality of channels in a width direction of each of the plurality of heat exchange tubes are equal to each other, and flow cross-sectional areas of the two adjacent channels are not equal to each other.

10. The heat exchanger according to claim 1, wherein an outer circumferential contour of the cross section of each of the plurality of heat exchange tubes taken along the left-right direction is roughly quadrilateral, and an inner diameter of the second pipe is 1.1 times or more of a width of each of the plurality of heat exchange tubes.

11. The heat exchanger according to claim 1, wherein flow cross-sectional areas of at least three channels in the plurality of channels are not equal to each other on the cross section of the plurality of heat exchange tubes taken along the left-right direction.

12. A heat exchanger, comprising:

a first pipe and a second pipe, wherein the first pipe comprises a circumferential wall and a main channel surrounded by the circumferential wall, an end in a length direction of the first pipe is a first end, the first end of the first pipe comprises a first end surface;

an inlet/outlet pipe connected to the first pipe;

a plurality of heat exchange tubes, wherein each of the plurality of heat exchange tubes is connected to the first pipe and the second pipe, each of the plurality of heat exchange tubes comprises a plurality of channels arranged to be spaced apart, each of the plurality of channels is connected to the first pipe and the second pipe, the plurality of channels comprise a first channel and a second channel, wherein, on a cross section of the plurality of heat exchange tubes taken along a left-right direction, a flow cross-sectional area of the first channel is greater than a flow cross-sectional area of another channel different from the first channel in the plurality of channels, and a flow cross-sectional area of the second channel is less than a flow cross-sectional area of another channel different from the second channel in the plurality of channels; and a first member, wherein the first member is disposed in the main channel of the first pipe, the first member extends by a predetermined distance along the length direction of the first pipe, the main channel comprises a first flow channel and a second flow channel, the first member is disposed between the first flow channel and the second flow channel, the first flow channel is connected to the inlet/outlet pipe, the second flow channel is connected to each of the plurality of heat exchange tubes, the first member comprises a plurality of through-holes, and each of the plurality of through-holes connects the first flow channel and the second flow channel, wherein a through-hole of the plurality of through-holes that has a smallest distance to the first end surface of the first pipe in the length direction of the first pipe is a first through-hole, d3 denotes the smallest distance between the first through-hole and the first end surface in the length direction of the first pipe, and $d3 < (10d1+9d2) * A1/A2$, wherein d1 denotes an overall tube thickness of each of the plurality of heat exchange tubes, d2 denotes a smallest distance between adjacent heat exchange tubes of the plurality of heat exchange tubes in the length direction of the first pipe, A1 denotes a flow cross-sectional area of the first channel on the cross section of each of the plurality of heat exchange tubes taken along the left-right direction, and A2 denotes a flow cross-sectional area of the second channel on the cross section of each of the plurality of heat exchange tubes taken along the left-right direction.

13. The heat exchanger according to claim 12, wherein the first member is a third pipe, the third pipe comprises a third circumferential wall, the third circumferential wall is disposed between the first flow channel and the second flow channel, and the third circumferential wall has the plurality of through-holes penetrating through the third circumferential wall.

14. The heat exchanger according to claim 13, wherein a side positioned upstream of the heat exchanger in a wind direction is defined as a windward side, a side positioned downstream of the heat exchanger in the wind direction is defined as a leeward side, the first channel is positioned on the windward side, and at least some of the plurality of through-holes are positioned on the leeward side.

15. The heat exchanger according to claim 13, wherein a side of the heat exchanger positioned upstream in a wind direction is defined as a windward side, a downstream side of the wind direction of the heat exchanger is defined as a leeward side, a sum of flow cross-sectional areas of channels positioned on the windward side among the plurality of channels is greater than a sum of flow cross-sectional areas of channels positioned on the leeward side among the plurality of channels, and at least some of the plurality of through-holes are positioned on the leeward side.

16. The heat exchanger according to claim 14, wherein some through-holes of the plurality of through-holes are positioned on the windward side, other through-holes of the plurality of through-holes are positioned on the leeward side, and a sum of flow cross-sectional areas of the some through-holes on the windward side is less than a sum of flow cross-sectional areas of the other through-holes on the leeward side.

17. The heat exchanger according to claim 13, wherein an end of the third pipe is connected to the inlet/outlet pipe, another end of the third pipe has a hole, and a flow cross-sectional area of the hole is less than a flow cross-sectional area of the third pipe.

18. The heat exchanger according to claim 12, wherein a hydraulic diameter of the second pipe is greater than or equal to 1.1 times of a hydraulic diameter of the first pipe.

19. The heat exchanger according to claim 12, wherein an outer circumferential contour of the cross section of each of the plurality of heat exchange tubes is roughly quadrilateral, and an inner diameter of the second pipe is 1.1 times or more of a width of each of the plurality of heat exchange tubes.

20. The heat exchanger according to claim 12, wherein flow cross-sectional areas of at least three of the plurality of channels are not equal on the cross section of the plurality of heat exchange tubes taken along the left-right direction.

* * * * *